US007243667B2

(12) United States Patent
Floriani

(10) Patent No.: US 7,243,667 B2
(45) Date of Patent: Jul. 17, 2007

(54) CRUTCH BAG

(76) Inventor: Dan Floriani, 717 1/2 Jasmine Ave., Corona del Mar, CA (US) 92625

( * ) Notice: Subject to any disclaimer, the term of this patent is extended or adjusted under 35 U.S.C. 154(b) by 270 days.

(21) Appl. No.: 11/025,294

(22) Filed: Dec. 28, 2004

(65) Prior Publication Data

US 2006/0137728 A1 Jun. 29, 2006

(51) Int. Cl.
*A61H 3/02* (2006.01)

(52) U.S. Cl. ..... 135/68

(58) Field of Classification Search ..... 135/66, 135/68, 69, 71, 72, 73, 75, 76; 224/407; 16/111.1

See application file for complete search history.

(56) References Cited

U.S. PATENT DOCUMENTS

| | | | | | |
|---|---|---|---|---|---|
| 2,311,049 | A | * | 2/1943 | Hedden | 135/68 |
| 3,985,148 | A | | 10/1976 | Cadman | |
| 4,027,687 | A | | 6/1977 | McGowan | |
| 4,146,045 | A | * | 3/1979 | Grant | 135/66 |
| 4,289,156 | A | | 9/1981 | Ulics | |
| 4,295,483 | A | * | 10/1981 | Smith | 135/66 |
| 4,850,383 | A | * | 7/1989 | McBride | 135/66 |
| D310,134 | S | | 8/1990 | VanDyke | |
| 5,340,005 | A | * | 8/1994 | Woods et al. | 224/407 |
| 5,465,884 | A | | 11/1995 | Bohl et al. | |
| 5,511,710 | A | * | 4/1996 | Woods et al. | 224/407 |
| 5,513,789 | A | * | 5/1996 | Woods et al. | 224/407 |
| 5,526,836 | A | | 6/1996 | Sigsworth | |
| 6,026,833 | A | | 2/2000 | Conte | |
| D487,966 | S | | 4/2004 | Stolzoff | |
| 2002/0056736 | A1 | | 5/2002 | Conte | |

FOREIGN PATENT DOCUMENTS

FR 2596259 A1 * 10/1987

* cited by examiner

*Primary Examiner*—David R. Dunn
*Assistant Examiner*—Danielle Jackson
(74) *Attorney, Agent, or Firm*—Gene Scott; Patent Law & Venture Group

(57) ABSTRACT

A crutch has dual spaced apart upright struts, each providing vertically spaced apart fastener receivers. A sleeve of a flexible and elastic material has an open top and bottom rims. A side wall of the sleeve converges downwardly with the open top rim larger than the bottom rim. A pair of opposing outer panels of a flexible and abrasion resistant material are sewn conformingly exterior to the sleeve. At least one of the outer panels provides an open notch adjacent the open top rim so as to better enable the open top rim of the sleeve to be expanded for receiving articles into the apparatus for carrying. A pair of fasteners are fixed in opposing positions adjacent to the open top rim, the fasteners engaged with the fastener receivers of the crutch for holding the carry bag on the crutch.

6 Claims, 2 Drawing Sheets

CRUTCH BAG

BACKGROUND OF THE INVENTION

Related Applications

1. Field of the Invention

This invention relates generally to crutches of the type used by the lame and also to carry bags used for transporting small amounts of goods manually, and more particularly to a combination crutch and carry bag for enabling a lame person to carry personal articles and such.

2. Description of Related Art

The following art defines the present state of this field and each disclosure is hereby incorporated herein by reference:

Stolzoff, U.S. D487966, discloses an ornamental design for a crutch overlay, as shown and described.

VanDyke, U.S. D310134, discloses an ornamental design for a crutch cover.

Williams, U.S. Pat. No. 354,392, shows an ornamental design for a cover for a crutch, as shown and described.

Cadman, U.S. Pat. No. 3,985,148, discloses a crutch carry-all attachment for holding letters, papers, books and magazines, including a compartment having a flat side detachably secured to a crutch and the opposite side hinged on a horizontal pivot, so that it can drop into a horizontal position. The side that drops has an opening formed therein for holding a cup such as is used for beverages. Magnets on the crutch help to secure the attachment in place, holding the hinged side in closed position when this is desired, and the flat side as well.

McGowan, U.S. Pat. No. 4,027,687, discloses a protective and/or decorative cover for a walking aid which has a plurality of interconnected members, including at least one support member and one or more leg members, said cover being of flexible material and including one or more non-split primary tube portions with open ends to slidably enclose one or more of said leg members, and one or more elongate secondary tube portions which are split longitudinally for wrap-around enclosing engagement with other leg or support members. Each split tube portion has opposed edge surfaces which are provided with releasable, interengaging fastening means to hold each split tube portion about its related support or leg member in a neat and close engagement.

Grant, U.S. Pat. No. 4,146,045, discloses a crutch carry-all attachment for holding letters, papers, cigarettes, pocket radios, pencils and the like, of unitary preferably all plastic construction having outwardly opening grooves which engage the side rails of a crutch to removably secure the attachment in place.

Ulics, U.S. Pat. No. 4,289,156, discloses a container that is suspended from the bolt that connects the handle of a crutch to the crutch side rails.

Smith, U.S. Pat. No. 4,295,483, discloses an accessory pouch mounting upon a crutch, having a central cavity for the portage of small articles, and having attached exterior pockets to carry additional items separately, and having attached exterior loops to which larger bundles may be tied for portage. A snugly fitting fabric envelope surrounds the side members of a common Y-type crutch and a fabric bottom in the fabric envelope closes the lower portion of the accessory pouch thus formed with a trouser-like fit against the side members of a common Y-type crutch. A pair of binding posts pass through holes in the upper portion of the fabric envelope, and locate in the standard handle adjustment holes provided in the side members of a common Y-type crutch, thereby securing the accessory pouch against relative movement or slippage upon the Y-type crutch. The crutch-mounted accessory pouch provides for the portage of accessory items and small burdens by lame or handicapped persons without encumbrance of the hands, and in addition to or instead of such portage by handbags, or pockets in clothing.

McBride, U.S. Pat. No. 4,850,383, discloses an upwardly opening and downwardly tapering bag-type container that is provided and receivable within the crotch area of a conventional Y-type crutch above the lower leg thereof and below the transverse handle of the crutch. Opposite side portions of the open upper end of the bag include tie straps for securement about opposite ends of the handle and the lower closed end of the bag includes tie straps for encircling the downwardly convergent lower portions of the side rails of the crutch immediately above the center depending leg thereof. The open upper end of the bag includes thistle-type fastener structure operatively associated therewith for releasably closing the open upper end of the bag.

Woods, et al., U.S. Pat. No. 5,340,005, discloses reflective fabrics that are used extensively throughout strong, expandable, selectively and resiliently restrained, fabric accessories for removable securement to crutches and walkers, to provide expandable carrying volumes for personal use items and shopping items, while at the same time presenting the reflective fabric portions to be readily observed, especially by operators of vehicles.

Bohl, et al., U.S. Pat. No. 5,465,884, discloses a carrying pack for a crutch and a method for using the pack. The carrying pack has plural sidewalls and a bottom wall that are integrally coupled together about a cavity. Flaps extend from a backside wall for location about crutch arms. The flaps have apertures extending therethrough that accept the shaft of a crutch hand grip bolt therethrough. The handgrip bolt secures the flaps to the crutch arms, securing the pack to the crutch. Straps also extend from the backside wall. The straps may be cinched about the crutch to stabilize the pack on the crutch. Inner and outer pockets are provided in the carrying pack for further storage space.

Woods, et al., U.S. Pat. No. 5,511,710, discloses reflective fabrics that are used extensively throughout strong, expandable, selectively and resiliently restrained, fabric accessories for removable securement to crutches and walkers, to provide expandable carrying volumes for personal use items and shopping items, while at the same time presenting the reflective fabric portions to be readily observed, especially by operators of vehicles. In this Divisional Application, the claims are directed to providing a pocket accessory for crutches.

Sigsworth, U.S. Pat. No. 5,526,836, discloses a crutch carrying bag including a bag member which has a user securable flap; and a strap assembly with two elongated strap members. Each strap member has a snap latch fastener secured to one end thereof and an O-ring connector securing a second end thereof to the bag member. The two snap latch/O-ring pairs are engagable to form a pair of closed loops that are connected about the hand grip of a crutch to secure the bag member to the crutch during use. The exterior of the securable flap preferably includes a beeper clip slot sized to receive therein the clip of a beeper.

Conte, U.S. Pat. No. 6,026,833, discloses pockets for use on a crutch consisting of a front panel and a back panel secured to one another along three sides, leaving an open end. Alternatively, the pocket has at least one side panel positioned between the front and back panels. The back panel preferably has a length greater than the length of the front panel and the width of the side panel to form a closure flap. The pocket-securing portion is affixed to one end of the back panel proximate the open end and secured to the crutch at the horizontal top rail by eyehooks. A retaining strap proximate the closed end secures the pocket to the side rails. In another embodiment for use on the lower portion of the crutch, the back panel has a length at least twice the length of the front panel and is folded upon itself to form a U-shape. A channel is secured to the crook of the U-shape to form a channel to receive a retaining bolt secured to the side rails. A secondary layer is affixed to a second leg of said U-shape to form a second pocket.

Conte, U.S. Pat. No. 0,056,736, discloses a pocket system that provides easy attachment to a variety of support surfaces, such as crutches, walkers, backpacks, etc. The system has at least one pocket having an open end to receive articles. At least one pocket securing member is attached to the back of the pocket proximate the open end to affix the pocket to a horizontal portion of the support surface. A stabilizing strap, or straps, is affixed to the back of the pocket proximate the closed end, adding stability by affixing the pocket to a vertical portion of the support surface. Preferably the stabilizing straps extend from opposite sides of the pocket for maximum security. One end of the securing members(s) and strap(s) can be permanently secured to the pocket, with the other end removably affixed through various means known in the art. Alternatively all of the methods of attachment of the pocket securing member(s) and stabilizing strap(s) can be removable.

Our prior art search with abstracts described above teaches: crutch carry-all attachment devices, protective and/or decorative covers for walking aids, a crutch attachment, a crutch mounted accessory pouch, a crutch bag, fabric accessories for crutches and walkers, crutch carrying packs, pockets for attachment to a crutch, and various designs for covering crutches. Although the concept of attaching a carry bag to a crutch is known in this art and although such items are known to be attached to the crutch in various ways, the present invention is novel in the materials of construction and they manner in which the carry bag engages the crutch, the neoprene sleeve gripping the crutch tightly. Also, the combination of an elastic carry pouch with a more rigid and abrasion resistant outer wall is novel in the art and provides the advantage of, being expansive for at once, carrying items of both large and small size, and yet being resistive to hard contacts which are common during use of a crutch. The prior art fails to teach such a combination. The present invention fulfills these needs and provides further related advantages as described in the following summary.

SUMMARY OF THE INVENTION

The present invention teaches certain benefits in construction and use which give rise to the objectives described below.

In one of the best mode preferred embodiments of the present invention, a crutch has dual spaced apart upright struts, each providing vertically spaced apart fastener receivers. A sleeve of a flexible and elastic material has an open top and bottom rims. A side wall of the sleeve converges downwardly with the open top rim larger than the bottom rim. A pair of opposing outer panels of a flexible and abrasion resistant material are sewn conformingly exterior to the sleeve. At least one of the outer panels provides an open notch adjacent the open top rim so as to better enable the open top rim of the sleeve to be expanded for receiving articles into the apparatus for carrying. A pair of fasteners are fixed in opposing positions adjacent to the open top rim, the fasteners engaged with the fastener receivers of the crutch for holding the carry bag on the crutch.

A primary objective of the present invention is to provide an apparatus and method of use of such apparatus that yields advantages not taught by the prior art.

Another objective of the invention is to provide a carry bag that enables a lame person on crutches to transport articles without the use of hands.

A further objective of the invention is to enable the small articles to be secured by an elastic sleeve jacket expansive for holding both larger and smaller articles with tight compressive forces holding the articles.

A still further objective of the invention is to enable the elastic sleeve jacket to have some rigidity and abrasion resistance to better secure the articles by providing outer side panels of non-expandable material.

A still further objective of this invention is to provide a flexible and elastic stocking-like enclosure on a crutch that is held at its ends so that objects tend to be placed and to move into the center of the enclosure to maintain center of gravity of the objects at the center of the crutch so as to avoid an unbalanced condition.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
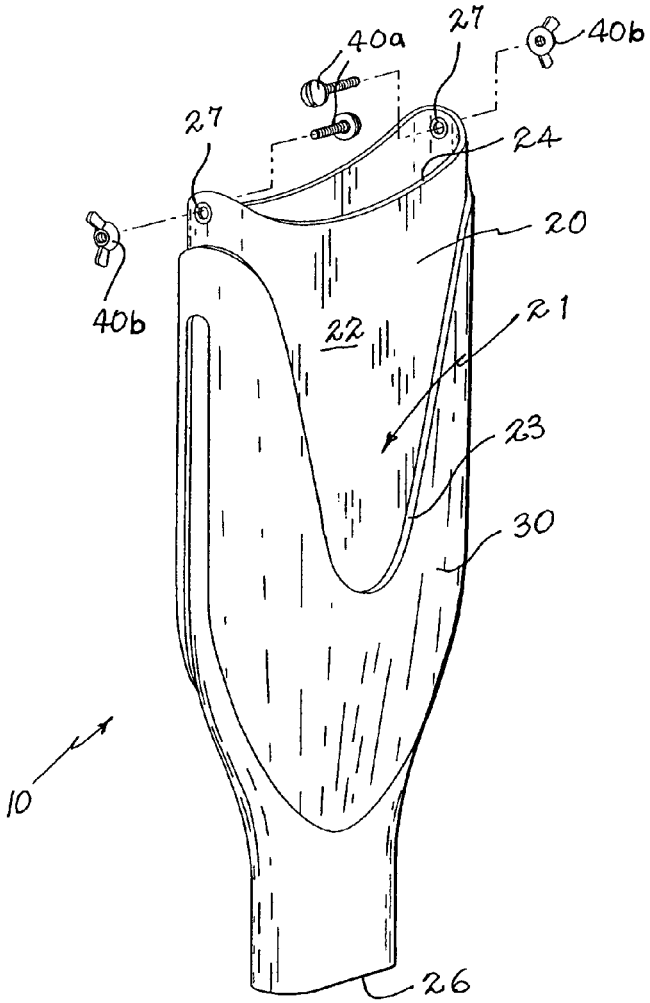
FIG. 1 is a frontal perspective view of one embodiment of the invention showing mounting hardware to be used for mounting the invention onto a crutch.
Figure 2:
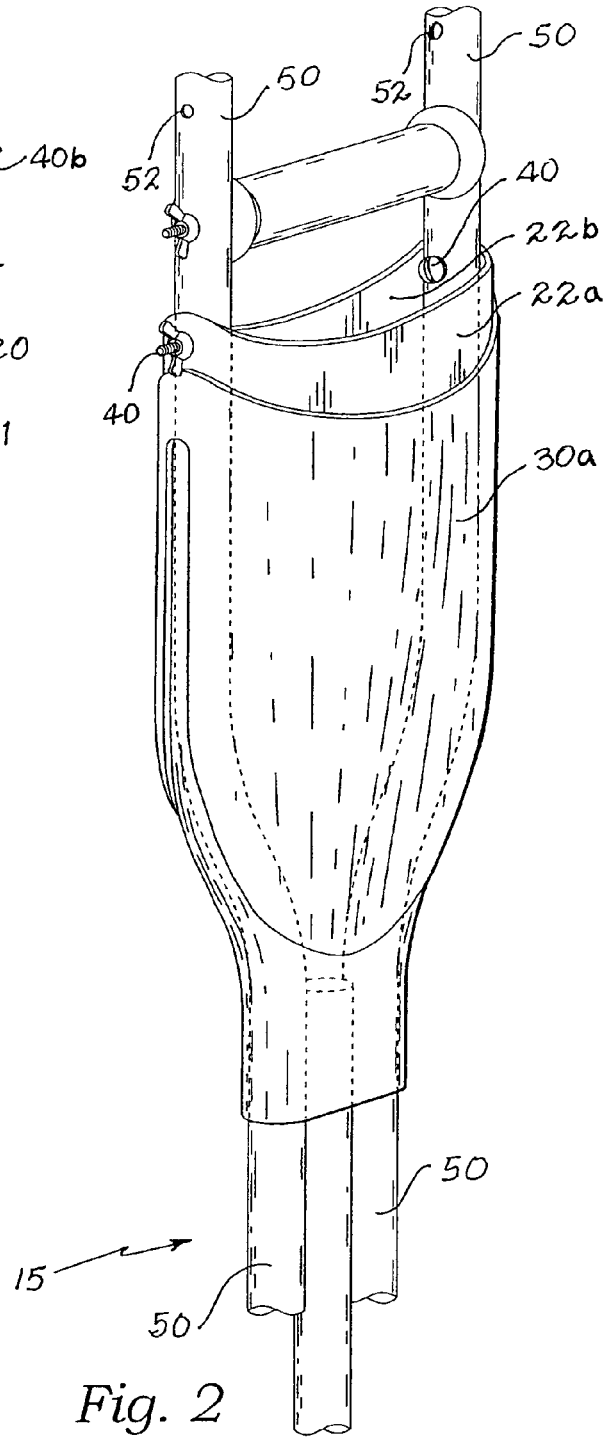
FIG. 2 is a rearward perspective view thereof showing the invention as a combination of a vertically oriented carry bag and a crutch which slides over the crutch and engages the crutch with the hardware.

In one embodiment of the present invention a carry bag 10 is used in combination with a crutch 15. The carry bag 10 includes a sleeve 20 of a flexible and elastic material such as neoprene rubber and is constructed with a side wall 22 with open top rim 24 and open bottom rim 26. The side wall 22 is convergent downwardly so that the open top rim 24 is larger than the open bottom rim 26. The side wall 22 is formed with opposing side panels 22*a* and 22*b*. A pair of opposing outer panels 30*a* and 30*b* are made of a flexible and abrasion resistant material such as acrylic plastic, Nylon® plastic or a combination of these two plastics or similar materials as would be known to one of skill in the art. These outer panels 30*a* and 30*b* are sewn conformingly exterior to the side panels 22*a* and 22*b* respectively as shown in FIGS. 1 and 2. At least one of these outer panels 22*a* and 22*b* provides an open notch 21 defined by edge 23 and this notch 21 extends downward from the open top rim 24 so as to better enable the open top rim 24 and the side panel 22*b* of the sleeve 20 to be expanded for receiving articles (not shown) that are placed into the carry bag 10 for transport. A pair of fasteners 40, such as screws 40*a* and wing nuts 40*b* are fixed in opposing positions on the side wall 22 adjacent to the open top rim 24, the fasteners 40 are spaced for engagement with the crutch 15 for engaging the carry bag 10 with the crutch 15.

In an alternate embodiment, the carry bag 10 and crutch 15 are used in combination together to form the apparatus of this invention. The crutch has dual spaced apart upright struts 50 each providing vertically spaced apart fastener receivers 52, as best seen in FIG. 2. The struts 50 are preferably made of a structural material such as metal, wood or plastic and the receivers 52 are preferably holes as shown in FIG. 2. The carry bag 10 is as described above. The fasteners 40 are engaged with the crutch 15 in the receivers 52 through sleeve holes 27 for securing the carry bag 10 to the crutch 15 as is well shown in FIG. 2. The open rims 24 and 26 are of such size as to fit tightly about the respective portions of crutch 15.

Figure 3:
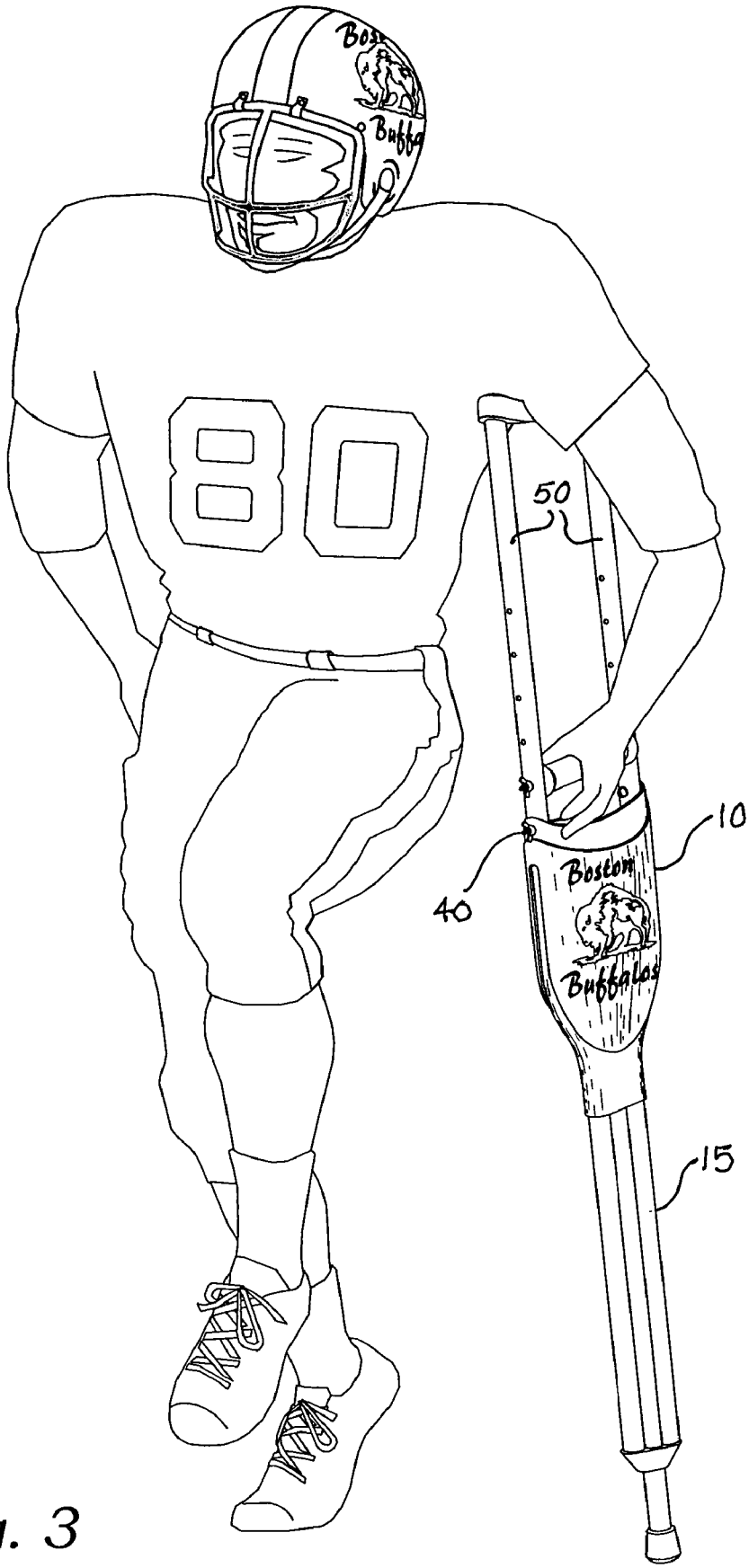
FIG. 3 is an illustration of the invention in use.

In use, as shown in FIG. 3, the carry bag 10 and crutch 15 combination provides for handy and convenient transport of small articles, and personal items when a person is not able to easily carry such items by hand. FIG. 3 shows a person using one crutch 15, but best use of the invention is called for when the person is required to use two crutches 15 and has no free hand.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A carry bag apparatus for use in combination with a crutch, the apparatus comprising: a sleeve of a flexible and elastic material, the sleeve providing a side wall with open top rim and open bottom rim thereof, the side wall convergent downwardly so that the open top rim is larger than the open bottom rim, the side wall formed with opposing side panels; a pair of opposing outer panels, of a flexible and abrasion resistant material, sewn conformingly exterior to the side panels, at least one of the outer panels providing an open notch adjacent the open top rim so as to better enable the open top rim of the sleeve to be expanded for receiving articles to be placed into the apparatus for carrying therein; a pair of fasteners fixed in opposing positions adjacent to the open top rim, the fasteners spaced for engagement with the crutch for holding the apparatus on the crutch.

2. The apparatus of claim 1 wherein the sleeve is made of neoprene rubber.

3. The apparatus of claim 1 wherein the outer panels are made of at least one of nylon and acrylic plastic.

4. A combination carry bag and crutch apparatus comprising: a crutch having dual spaced apart upright struts; each of the struts providing vertically spaced apart fastener receivers; a sleeve of a flexible and elastic material, the sleeve placed over the crutch; the sleeve providing a side wall with open top rim and open bottom rim, the side wall convergent downwardly in accordance with a conformation of the crutch; the open top rim being larger than the open bottom rim, the side wall formed with opposing side panels; a pair of opposing outer panels, of a flexible and abrasion resistant material, sewn conformingly exterior to the side panels, at least one of the outer panels providing an open notch adjacent the open top rim so as to better enable the open top rim of the sleeve to be expanded for receiving articles to be placed into the apparatus for carrying therein; a pair of fasteners fixed in opposing positions adjacent to the open top rim, the fasteners engaged with the fastener receivers of the crutch for holding the carry bag on the crutch.

5. The apparatus of claim 4 wherein the sleeve is made of neoprene rubber.

6. The apparatus of claim 4 wherein the outer panels are made of at least one of nylon and acrylic plastic.

* * * * *